United States Patent [19]

Logtens

[11] Patent Number: 4,546,910

[45] Date of Patent: Oct. 15, 1985

[54] ACTIVE CLINCHERS AND WIRE STITCHERS INCORPORATING SAME

[75] Inventor: Jozef P. M. Logtens, Meerlo, Netherlands

[73] Assignee: Xerox Corporation, Stamford, Conn.

[21] Appl. No.: 511,033

[22] Filed: Jul. 5, 1983

[30] Foreign Application Priority Data

Jul. 7, 1982 [GB] United Kingdom ..... 8219713

[51] Int. Cl.[4] ..... B25C 7/00

[52] U.S. Cl. ..... 227/155; 140/93 D

[58] Field of Search ..... 227/155; 140/93 D, 105; 29/243.56, 243.5, 741, 739

[56] References Cited

U.S. PATENT DOCUMENTS

| | | | |
|---|---|---|---|
| 2,902,689 | 9/1959 | Petersen | 227/155 |
| 2,964,749 | 12/1960 | Kwasniewski et al. | 1/2 |
| 2,987,729 | 6/1961 | Taynton | 1/220 |
| 3,669,447 | 6/1972 | Turner et al. | 271/53 |
| 3,804,317 | 4/1974 | Gelzer | 227/155 |
| 3,986,533 | 10/1976 | Woodman, Jr. | 140/105 |
| 4,194,666 | 3/1980 | Spehrley, Jr. et al. | 227/155 |
| 4,328,919 | 5/1982 | Lawrence et al. | 227/155 |

*Primary Examiner*—Francis S. Husar
*Assistant Examiner*—Linda McLaughlin
*Attorney, Agent, or Firm*—Bernard A. Chiama

[57] ABSTRACT

An active clincher 201 has a housing 202 forming a support surface 203 for an article, such as a set of sheets, to be stapled. One or a pair of clincher ears 204 is positively driven by an actuator 223 for bending over the staple leg(s) to form clinches. The clincher ears 204 are pivotally mounted on the housing 202 and rotatable by the actuator 223 so as to engage and bend the staple legs. The or each clincher ear 204 is mounted, suitably by having a slotted pivot hole 212, so that it also moves normally to the support surface during and/or following the end part of the rotational movement of the ear.

5 Claims, 6 Drawing Figures

ACTIVE CLINCHERS AND WIRE STITCHERS INCORPORATING SAME

Figure 1:
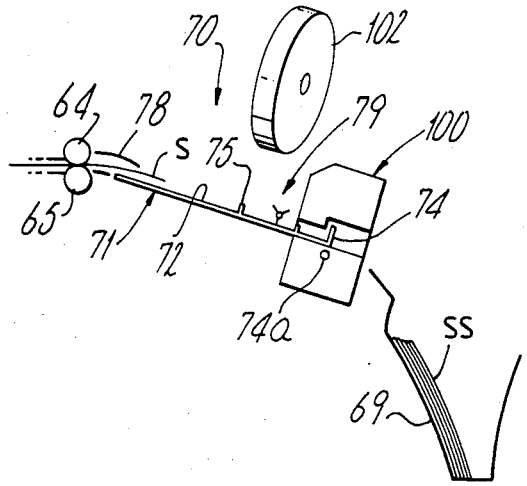

This invention relates to active clinchers for bending over the ends of staple legs to form clinches and to wire stitchers for use in binding sets or signatures of sheets or documents incorporating such clinchers.

Stitchers take various well known forms. There are those (called staplers) which use pre-formed staples, those using pre-cut lengths of wire which are formed in the machine and those in which the staples are formed from a continuous wire wound on a spool from which pieces are cut and formed in the machine. In each case the legs of the formed staple or stitch are driven through the set until the crown of the staple lies against one face of the set and the ends of the staple legs are bent over against the opposite face of the set to form clinches. The present invention is concerned with stitchers of all the above kinds.

More particularly the invention is concerned with stitchers for binding sheets into sets which have active clinchers that is to say clinchers having ears which are positively driven to bend the staple legs against the set. Examples of stitchers having active clinchers are shown in U.S. Pat. Nos. 2,964,749, 2,987,729, 3,804,317, and 3,986,533 and 4,328,919. The clincher described in the U.S. Pat. No. 4,328,919 has ears which are driven through a combined pivoting and translating movement between a retracted position below the surface in which their side and end edges are respectively inclined towards and away from each other in the staple driving direction to a position in which the side edges are generally parallel and the end edges project slightly beyond the clamping surface but are preferably still inclined away from each other by a small angle so as to slightly overclinch the staple. The present invention however is particularly concerned with active clinchers of the kind having a support surface for an article to be stapled and a clincher ear which is pivotally mounted on a support including said support surface and rotatable by an actuator so as to engage and bend the staple leg. It has been found that due to tolerance variations in the clincher and the driver of the stitcher, which increase during the life of the machine, such active clinchers will often produce either an open clinch in which the protruding legs of the staple are not bent flat against the bottom of the set or a buckled crown in which the legs have been distorted upwardly rather than being smoothly bent around the bottom of the set. Although such problems can to some extent be alleviated by building the clincher to close tolerances, these tend to change during the life of the device so that the problem is still presented.

It is an object of the present invention to alleviate the above problem and to this end an active clincher according to the invention is characterised in that the clincher ear is pivotally mounted so as to be movable by said actuator normally to said support surface during and/or following the end part of the rotational movement of the ear. Thus the ear not only has a rotational movement for bending the staple leg but also has a translational movement for flattening the staple leg positively against the underside of the article.

In a preferred form the clincher ear is pivoted on a axle passing through a slotted hole in the clincher ear, this slotted hole being so arranged as to extend generally normally to said support surface at the end of the rotational movement of the ear. Since the hole will be at an angle to the direction of movement of the actuator during the preceding part of the rotational movement of the ear the translating motion of the ear will not occur until to at or near the end of the rotational movement.

In a preferred form the clincher has a pair of said ears for acting on a conventional two-legged staple.

From a different aspect the invention is defined as having a clincher ear which is rotatable about an axis which is fixed in position during clinching so as to engage and bend the staple leg, being mounted so as to be movable towards the crown of a staple being clinched during and/or following the end part of the rotational movement of the ear.

There is also provided according to the invention a wire stitcher for binding a set of sheets having a driver for driving a staple through a said set and an active clincher as described above having two clincher ears for bending over the ends of the staple legs to form clinches, said clincher being movable for clamping a set to be bound between the driver and said support surface of the clincher. Such a stitcher may be incorporated with a sheet stitcher/compiler as part of a finisher for a photocopier and such a finisher may form part of the photocopier or take the form of a separate unit.

Figure 2:
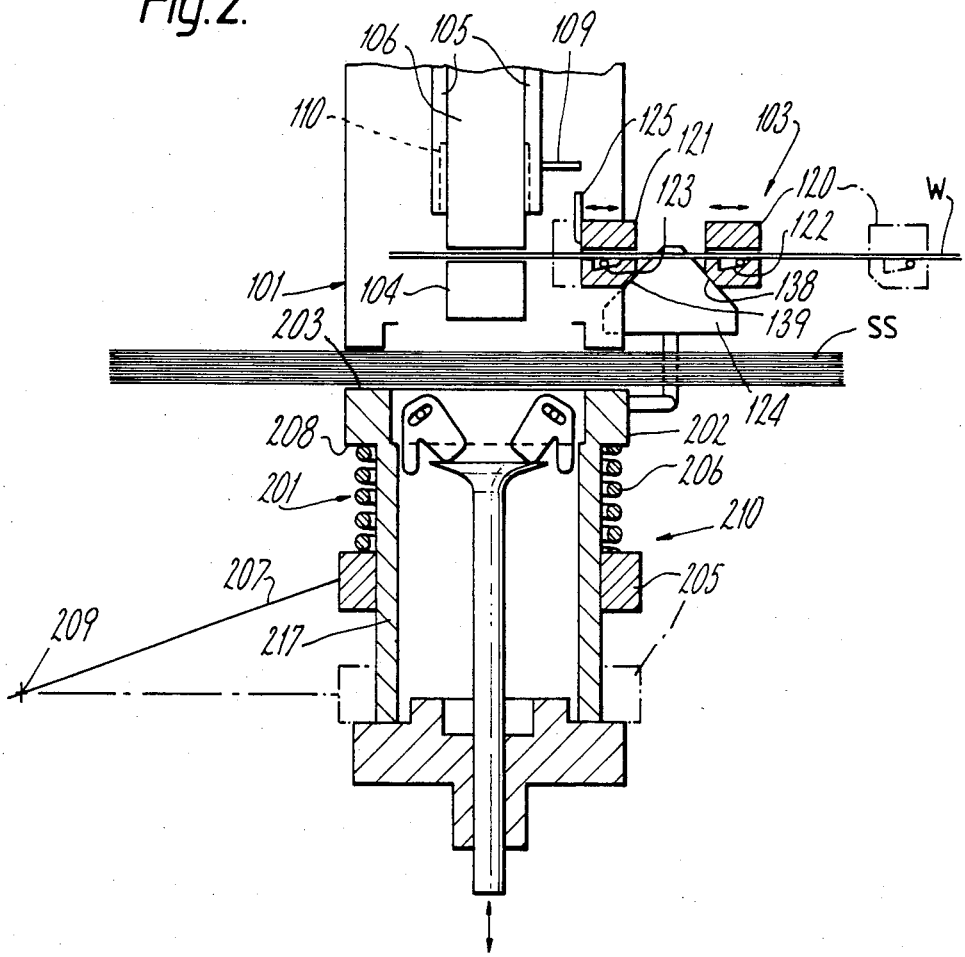
Figure 3:
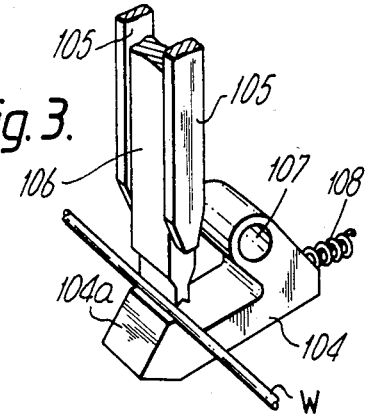
Figure 4:
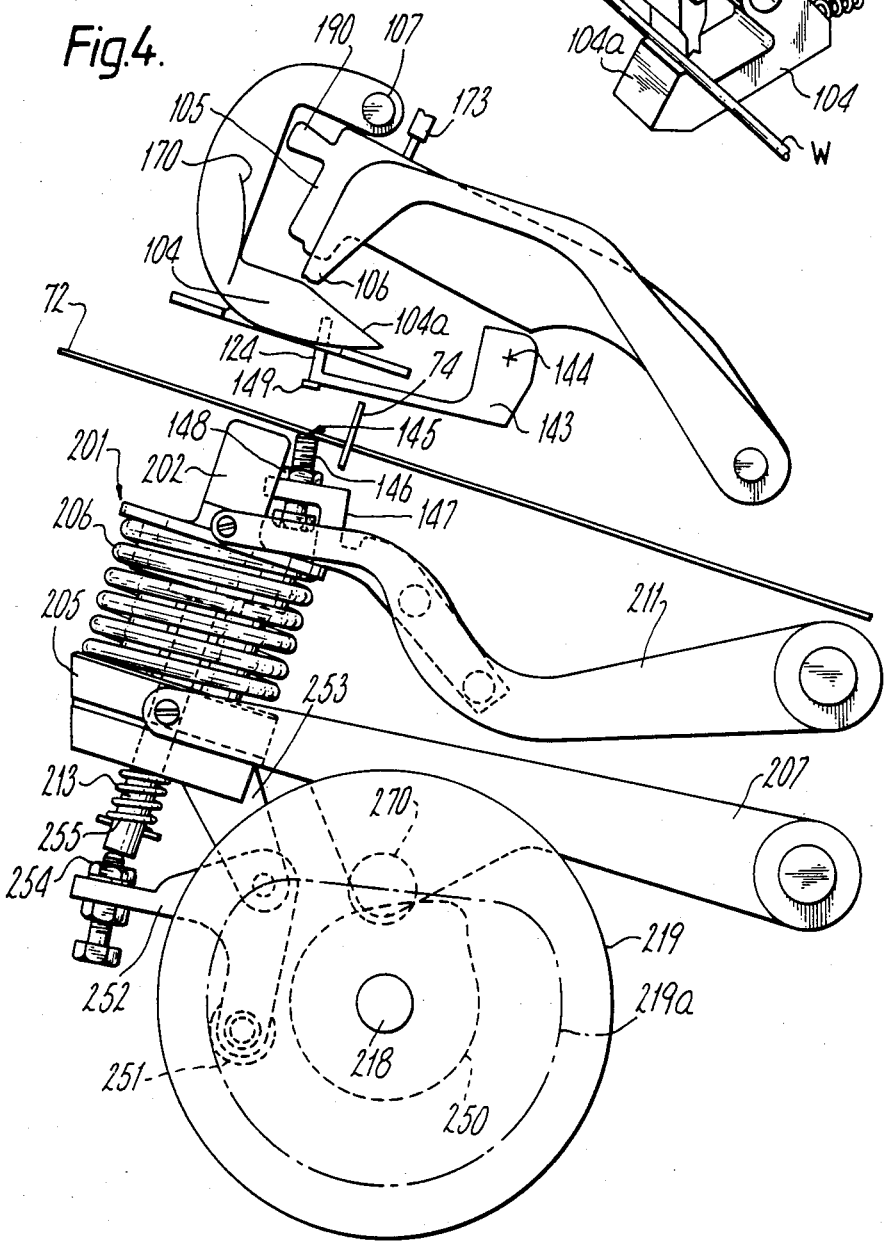
Figure 5:
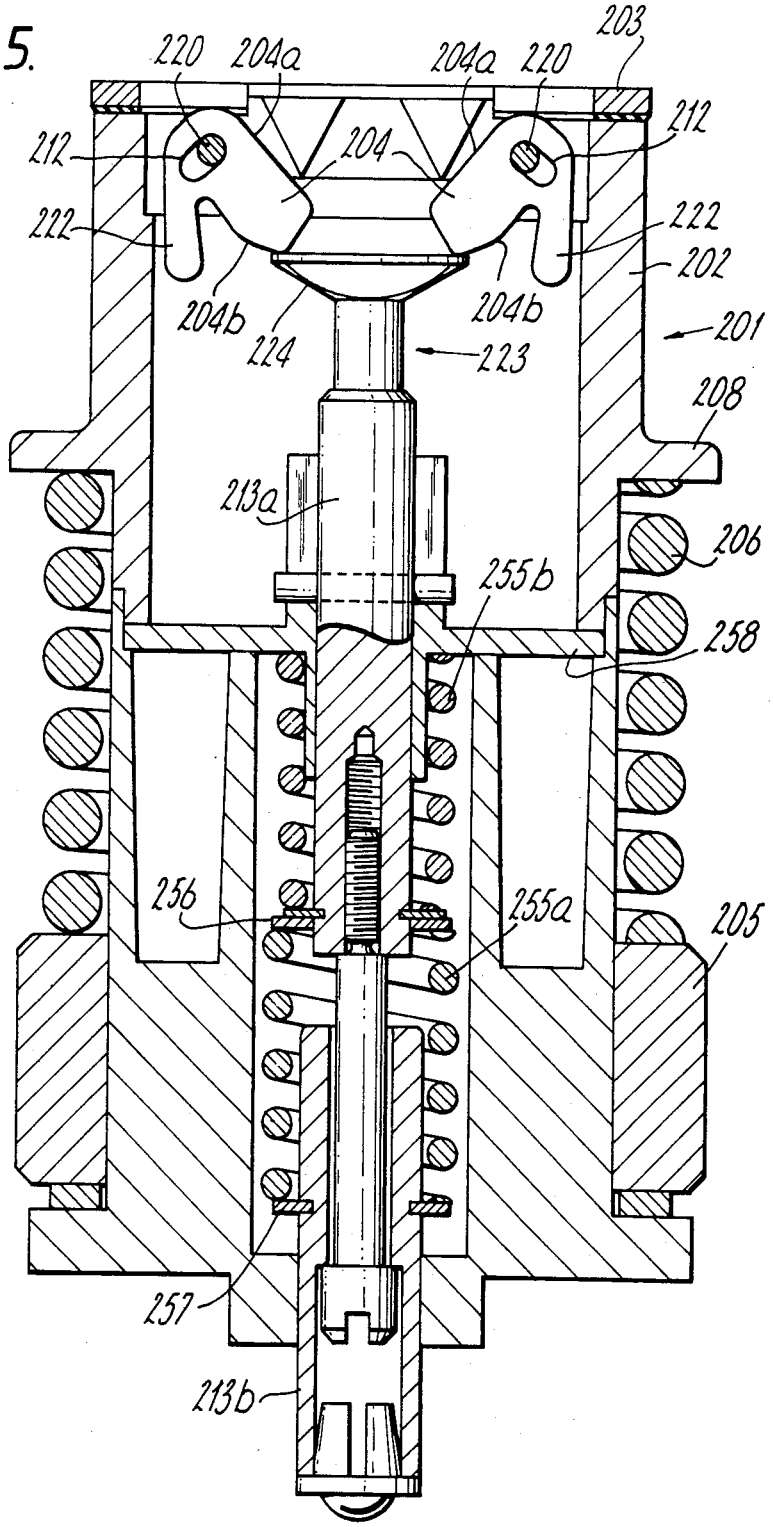
Figure 6:
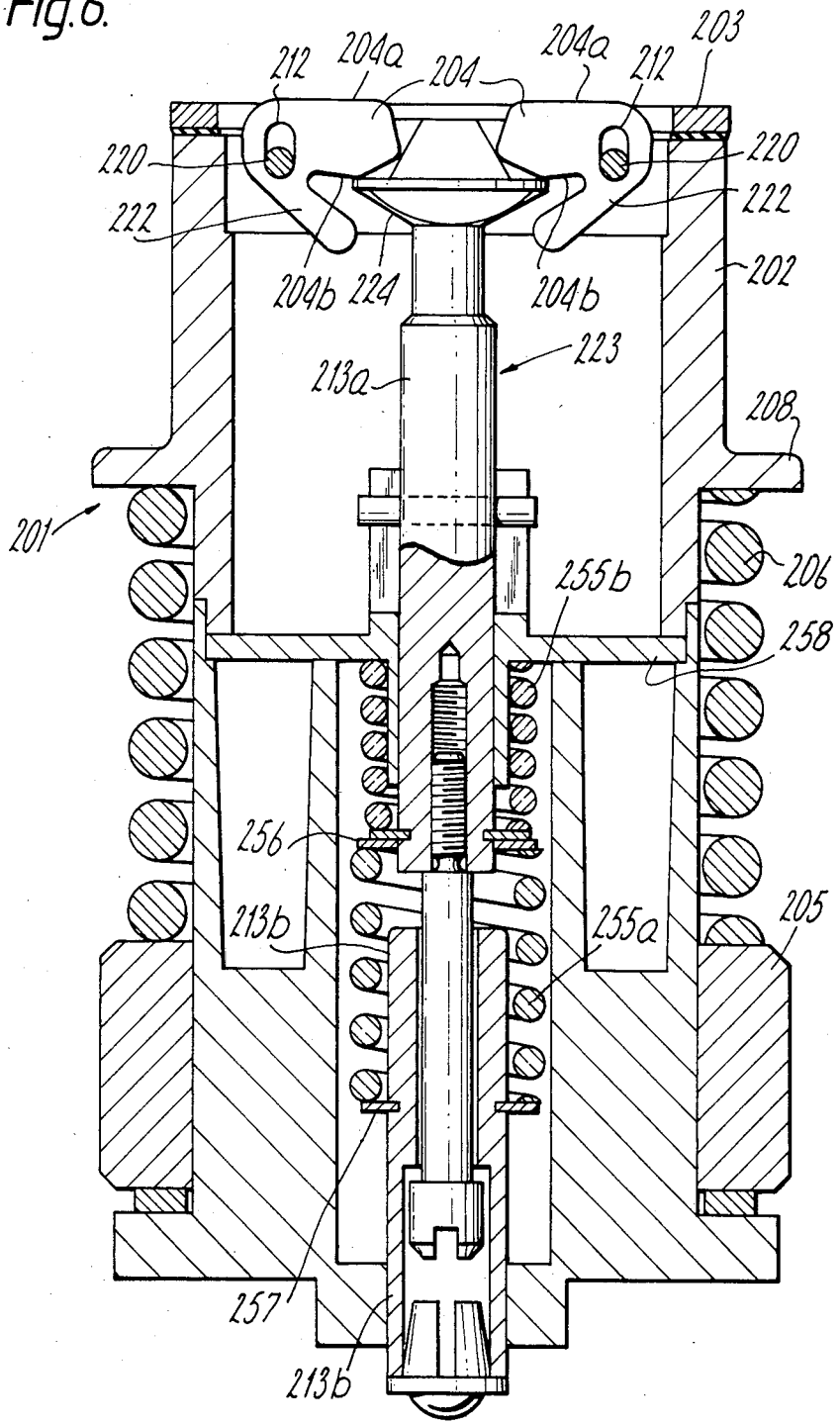

In order that the invention may be more readily understood, reference will now be made to the accompanying drawings in which:

FIG. 1 is a schematic side elevation of a finisher for a photocopier having a stitcher incorporating an active clincher according to this invention, FIG. 2 is a schematic view illustrating the principles of one embodiment of stitcher suitable for use in the finisher of FIG. 1, FIG. 3 is a scrap view of the stitcher shown in FIG. 1 illustrating schematically the relationship of various parts of the stitcher, FIG. 4 is a side elevation of the stitcher showing the drive for the clincher, and FIGS. 5 and 6 are like cross-sectional views of the clincher showing the clincher ears in the positions assumed at the start and end of the clinching operation respectively.

Referring to FIG. 1 there is shown a finisher 70 incorporating a stitcher 100 according to this invention. The finisher is adapted to be arranged at the output of a photocopier represented in the drawing by the output nip rolls 64, 65 thereof. Although particularly well suited for use with a photocopier, the apparatus generally designated 100 is equally well adapted for use with any number of devices in which cut sheets of material are delivered or compiled in a stack.

The finished 70 comprises a compiler tray 71 having a base or support surface 72 inclined downwardly in the direction of sheet travel towards a registration corner defined by registration fences 74, 75 extending along the lower edge and one side of the tray. Above the upper end of the support surface is arranged the pair of output feed rolls 64, 65 of the photocopier. From the feed rolls 64, 65 a sheet is directed by a guide plate 78 towards the tray 71. A corner registration device 79, such as a paddle wheel like that described in U.S. Pat. No. 3,669,447, is arranged over the surface 72 to urge the sheet S into the registration corner to position them to receive a stitch from the apparatus 100. The registration fence 74 is rotatable about an axis 74*a* so that it may be retracted for ejection of bound sets SS into a collection tray 69. Any suitable ejection mechanism, such as drive rollers, may be employed.

The stitcher 100 may take any suitable form but a preferred form thereof is described and illustrated in U.S. Pat. No. 4,356,947. As shown in FIG. 2, the stitcher 100 comprises a stitcher head 101, a spool 102 (FIG. 1) from which wire W is supplied to the head 101 and an active clincher 201 according to the invention. The head 101 includes a wire advancing and cutting mechanism generally indicated at 103 for presenting lengths of cut wire to the stitcher head, an anvil 104 for supporting the wire, a former 105 including two elements at opposite sides respectively of the driver for forming the wire into a generally U-shape about the anvil and a driver 106 for driving the formed staple through the set SS. The clincher 201 comprises a clincher housing or support 202 having a clamping surface 203 by which a set SS may be clamped against the underside of the stitcher head 101 and containing clinch ears 204 arranged to receive and act upon staple legs driven through the set and into the housing through a slot in the surface 203.

In FIG. 2 the clincher 201 is shown in its operative position with a set SS positioned against the head 101 which is fixed in position above the compiler tray 71. It will be understood, however, that during compilation of the set, the clincher is lowered so that the clamping surface 203 is below the support the surface of the compiler tray 71 of the finisher. During a stitching operation the clincher 201 is raised to lift the set SS against the underside of the head 101 and clamp it in position. Variations in set thickness are accommodated by the drive mechanism 210 by which the clincher housing is raised to lift the set against the underside of the stitcher head and clamp it into position to receive a stitch. This mechanism comprises a force applying ring 205 which lifts the housing 202 via a compression spring 206, being moved through a fixed distance by a lever 207 (see FIG. 2). The spring 206 is positioned between the force applying ring 205 and shoulder 208 of the housing 202. The lever 207, which is arranged to pivot about axis 209, is actuated by a cam 219 and the clincher housing 202 is supported and guided by a pair of arms 211 pivotally connected between the housing 202 and the frame of the stitcher. The lever 207 carries a cam follower 270 intermediate the force ring 205 and pivot axis 209 which is controlled by a face cam 219 the centre-line of the guideway of which is shown by the dash-dot line 219*a*. The cam 270 is mounted on a cam shaft 218.

The mechanism 210 in addition to accommodating varying set thickness, varies the clamping pressure applied to the set as a function of set thickness. Thus, the thinner the set the less the compression of spring 206 and the less the clamping force applied. The clincher ears 204 are mounted on the housing 202 so that they are always presented to the set in the same relation regardless of the set thickness. The drive to the clincher ears 204 is described below.

The wire advancing and cutting mechanism 103 comprises movable wire and cutting blocks 120, 121 and an inhibitor member 124 positioned by the clincher 201 in dependence on the thickness of the set SS. The blocks 120, 121 include wire diodes 122, 123 which grip the wire only against movement of the respective block in the direction opposite the wire advancing direction. Thus, the diodes grip the wire when the blocks are moved to the left but allow each block to be moved to the right along the wire while the other block holds the wire. At the start of a wire feed cycle, the blocks 120 and 121 are positioned as shown in dotted lines in FIG. 1. To feed the wire W, the advancing block 120 is moved to the left, diode 122 gripping the wire, to advance the wire passed the rest or start-of-cycle position of the cutter 125 by a distance made up of a constant (crown length plus twice clinch length) plus the set thickness, and the cutter block 121 is retracted from its rest position by a distance equal to the set thickness. These movements and thus the length of wire W presented to the stitched head 101 for severing by the cutter 125 is determined by the inhibitor member 124 which limits the movement of blocks 120, 121 according to the thickness of the set. The blocks 120, 121 are shown in full lines in their final positions at the end of a wire advancing movement. As the mechanism recycles to its start position (which takes place at the end of the complete stitching cycle), the cutter block 121 returns to its rest position pulling the wire with it—so that the wire end is always in the same position at the start of a feed cycle—and the advancing block 120 traverses back along the wire to its rest position.

The advancing block 120 and the cutter block 121 are both mounted for horizontal sliding movement on a guide rail (not shown). In FIG. 2, the wire advancing direction is from right to left and the cutter 125 is pivotally mounted on the left-hand end of the cutter block which forms a shear face. The cutter is actuated by a projection 109 on the former 105 as described below and is returned to its inactive position following an operating cycle by a tension spring (not shown). The blocks 120, 121 have bores through which the wire W is threaded and which incorporate the wire diodes 122, 123. The diodes comprise a cavity along the bore which contains a roller lightly loaded by a spring. The face of the cavity opposite the bore is inclined so that the cavity tapers in the wire advancing direction and the spring urges the roller into engagement with the wire. The inhibitor member 124 is mounted for vertical sliding movement with the clincher housing 202 as schematically illustrated in FIG. 2. The inhibitor member 124 has two opposed 45° faces which are engaged by 45° faces 138, 139 respectively on the advancing block 120 and the cutter block 121. Using 45° faces, the relationship between the position of the clincher housing and the inhibitor 124 is linear and 1:1.

While the inhibitor member 124 may be directly connected to the clincher housing 202 as schematically represented in FIG. 2, other arrangements are possible. Thus, as shown in FIG. 7, the inhibitor member 124 is carried on an arm 143 pivoted to the stitcher head at 144 and is positioned by means of an actuator 145 mounted on one of the clincher housing guide arms 211. As shown the actuator is adjustable for correctly setting the mechanism and comprises a bolt 146 threaded through a bracket 147 and locked into position by a nut 148. While the clincher is retracted, the inhibitor is supported by a limit stop 149.

The length of wire presented to the stitcher head 101 by the mechanism 103 is cut, formed and driven in the following manner. While the anvil 104, which is pivotally mounted at 107 and biased to its start-of-cycle position by a spring 108 as shown in FIG. 3, is held against movement, the driver 106 is moved downwardly against the wire to clamp it in position on the anvil. The former elements 105 then start moving downwardly. Initial movement of the former operates the cutter 125 through actuator 109 to sever the required wire length and further movement thereof shapes the wire about the anvil 104 into a generaly U-shape. In order to accommodate the wire during this operation the formers have guide grooves 110 along their inner faces. At the end of a forming operating the former is in its lower limit position with the lower ends of the former elements 105 below the underside of anvil 104 and adjacent the set. The driver 106 is now driven downwardly, pivoting the anvil about its axis 107, to drive the formed staple. As seen in FIG. 3 the anvil includes a sloping surface 104*a*. During the driving operation the anvil surface 104*a* forms a support for the crown of the staple. Similarly the former elements 105 serve to support the legs of the staple in the grooves 110 during the driving movement.

It will be realised from the foregoing that the anvil must be held against movement during the cutting and forming stage but be pushed out of the way during the driving stage. This may be achieved by using a spring 108 (FIG. 3) which is strong enough to hold the anvil stationary during cutting and forming. However, this requires that the force available to drive the driver must be sufficient also to overcome the resistances of the spring. It is preferred therefore that the anvil be held locked in position during the cutting and forming stage and released by the former 105 at the end of its travel whereby only a relatively light spring 108 is required which is sufficient to return the anvil to its start-of-cycle position and to ensure that the anvil supports the staple crown during the driving stage. One way of achieving this is shown in FIG. 4 in which the anvil is geometrically locked in position during the cutting and forming steps by arranging the pivot axis 107 above the line of pressure engagement between driver and anvil, the lock being released by a projection 190 on the former engaging an actuator surface 170 on the anvil support area.

As described above, the stitcher has a two stage driver action in which following wire feed a first stage motion operates to grip the wire W against the anvil 104 during cutting and forming and a second stage motion acts following forming to effect driving of the formed staple. A mechanism suitable for this operation based on pivoted motions which first holds the wire against the anvil and then provides the driving motion will form one continuous input lever travel described in U.S. Pat. No. 4,335,841.

The ends of the staple legs are turned over and wiped flat against the underside of the set by the clincher ears 204. The clincher 201 and its operation is described more fully below. However it should be noted that the clincher is operated so that the staple legs having passed through the set move through air and meet no further resistance during driver travel. This is achieved by arranging the clincher ears 204 out of the paths of the staple legs during driver travel.

The clincher ears 204 are pivotally mounted on the clincher housing 202 by means of axles 220 which pass through slotted holes 212 in the ears. FIG. 5 shows the clincher ears in their inactive or start-of-cycle positions prior to the start of the clinching operation, in which position they are out of the paths of the staple legs. FIG. 6 shows the positions of the ears at the end of a clinching operation. The ears are driven between these positions by an actuator 223 is arranged for vertical sliding movement in the clincher housing, i.e. normally to the surface 203, so as to rotate the clincher ears about the axles 220 from the position shown in FIG. 5 to that shown in FIG. 6. During this rotational movement the upper surfaces 204*a* of the clincher ears wipe against the staple legs and bend them over against the bottom of the set. As shown in FIG. 6, during the end part of the movement of the ears 204, the slotted holes 212 permit the ears to be translated in the direction of actuator movement normal to the surface 203 so as to ensure that the ends of the staple legs are positively and firmly pressed flat against the underside of the set.

Grooves (not shown) are provided in the upper surfaces 204*a* of the clincher ears to receive and guide the staple legs during bending thereof. These grooves should be wide enough to accommodate normal leg wander, it being understood that normal leg wander is that which will occur except in the case of malformed or maverick staples or mis-feeds.

The actuator 223 has a head 224, which engages the undersides 204*b* of the clincher ears 204, mounted on an actuator rod 213 which extends out through the bottom of the housing 202 and is acted upon by a cam drive 250 as shown in FIG. 4. As illustrated in FIG. 4 the clincher rod 213 is driven by an edge or ramp cam 250 mounted on the same drive shaft 218 as, and alongside, the cam 219 which drives the force-ring lever 207. The drive to the clincher rod from the cam 250 is effected by a roller follower 251 mounted on one end of a crank arm 252 pivoted to a bracket 253 depending outwardly from the clincher housing 202. The other end of the crank arm carries a stop 254 which engages the bottom end of the clincher rod 213. As shown, the stop 254 is adjustable to permit setting of the clincher ear movement. The clincher ears 204 are biassed to their open, retracted position by a spring schematically represented in FIG. 4 at 255. The cam shaft 218 is driven in synchronism with the head 101 drive and the cam 250 is disposed so that the clincher rod is driven only after the formed staple has been completely driven through the set. It will be noted that by using a drive arrangement as shown with the face cam 250, variations in set thickness are accommodated without affecting the timing (except to an insignificant degree caused by slight variations in the position of the cam follower 251 to cam 250) of the clincher ear movement relative to that of the driver.

Although schematically illustrated in FIG. 2 as being a solid member, it will be seen from FIGS. 5 and 6 that the actuator rod 213 is in two relatively movable parts 213*a* and 213*b*. It will also be seen that despite the simplified representation of a spring 255 in FIG. 4, there are two compression springs 255*a* and 255*b*. The spring 255*a* biases the two parts 213*a* and 213*b* of the actuator rod apart, being mounted between flanges 256, 257 on the actuator rod parts 213*a* and 213*b* respectively. The spring 255*b* biasses the actuator rod 213 to its retracted position, being mounted between a fixed flange 258 in the housing 202 and the flange 256. The spring 255*a* is stronged than the spring 255*b* so that during clinching movement of the rod 213 the spring 255*b* is compressed with the actuator rod parts 213*a*, 213*b* solidly joined by the spring 255*a*. At the end of the clinching cycle further movement of the rod part 213*b* by the cam drive 250 will be accommodated by the spring 255*a*, which defines the clinching force.

The undersides 204*b* of the clincher ears 204 are partly curved in order to provide a smooth rotational movement of the ears and include flat portions engaged by the actuator head 224 at the end of the rotational movement of the ears and during their translational movement. The slotted holes 212 in the ears are arranged and dimensioned so that the ears translate at the end of the rotational movements thereof but it will be understood that by having the axles 220 loosely fitted within the holes 212 translation of the ears 204 will occur during the end part of their rotational movements.

Nose portions 222 provided in the clincher ears 204 are engaged by the head 224 of the actuator 223 as it is retracted at the end of a clinching operation to return the clincher ears to their inactive positions. Retraction of the actuator is, of course, effected by the springs 255*a* and 255*b* as the cam drive 250 releases the actuator rod 213.

It is to be understood that although FIGS. 5 and 6 illustrate the principle of operation of a clincher according to the invention, in practice the clincher ears would be closer together (or longer) so that in the position shown in FIG. 6 the adjacent ends of the ears are closely spaced. This is necessary in order to act positively and firmly on the staple legs and support the turned-over portions (clinches) of the staple legs throughout their lengths.

Whilst a specific embodiment of the invention has been described above it will be understood that various modifications may be made to the specific details referred to herein without departing from the scope of the invention as defined in the appended claims. For example it will be understood that while in the embodiment described the stitcher head is fixed, the clincher could be fixed and the clamping means be formed by the sheet receiving surface of the head itself.

I claim:

1. A stitcher device having a frame, a support surface on said frame for supporting an article to be stapled, a clincher ear mounted below said support surface, means pivotally mounting the ear on the frame, and an actuator mounted on said frame to engage and rotate the ear for bending a staple leg, the improvement wherein the means for pivotally mounting the clincher ear, upon engagement by the actuator imparts a generally perpendicular movement of the ear to the support surface following the end part of the rotational movement of the ear.

2. A stitcher device according to claim 1 wherein said ear is formed with a slotted opening and said means for mounting includes an axis pin extending through said opening and wherein said slotted opening is arranged so as to extend generally perpendicular to said support surface at the end of the rotational movement of the ear.

3. The stitcher device according to claim 1 including a driver mounted on said frame above said platform for driving a staple through the article and another clincher mounted on said frame for pivotal movement for bending over another staple leg to form a clinch, and means on said frame for clamping the article to be bound between the driver and said support surface.

4. A stitcher device according to claim 1 wherein the frame includes an article clamping surface and two clincher ears pivotally mounted thereon.

5. A stitcher device according to claim 1 wherein the actuator comprises a rod slideably mounted in the frame and movable perpendicular to the support surface, and a means for moving said rod.

* * * * *